US006736095B2

(12) United States Patent
Pierik

(10) Patent No.: US 6,736,095 B2
(45) Date of Patent: May 18, 2004

(54) EXTENDED DURATION CAM LOBE FOR VARIABLE VALVE ACTUATION MECHANISM

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 156 days.

(21) Appl. No.: 10/005,027

(22) Filed: Dec. 4, 2001

(65) Prior Publication Data

US 2003/0101951 A1 Jun. 5, 2003

(51) Int. Cl.[7] ..... F01L 1/34

(52) U.S. Cl. ..... 123/90.16; 123/90.15; 123/90.6; 74/569

(58) Field of Search ..... 123/90.15, 90.16, 123/90.17, 90.6; 74/569

(56) References Cited

U.S. PATENT DOCUMENTS 5,937,809 A 8/1999 Pierik et al.
6,055,949 A 2/2000 Nakamura et al. ..... 123/90.16
2002/0007809 A1 * 1/2002 Miyazato et al. ..... 123/90.16
2002/0035976 A1 * 3/2002 Nakamura et al. ..... 123/90.15

* cited by examiner

*Primary Examiner*—Thomas Denion
*Assistant Examiner*—Jaime Corrigan
(74) *Attorney, Agent, or Firm*—Patrick M. Griffin

(57) ABSTRACT

An output cam for a variable valve mechanism includes a body configured for being pivotally associated with and driven by an input shaft. A lift profile of the output cam includes a base circle portion, a cam portion and a fixed radius portion. The base circle portion is adjacent to and continuous with the cam portion, and the cam portion is adjacent to and continuous with the fixed radius portion. The base circle portion has a base radius, the cam portion has a cam radius and the fixed radius portion has a fixed radius. The base and fixed radii are substantially constant. The fixed radius is a predetermined amount greater than the base radius. The cam radius increases from a value approximately equal to the base radius adjacent the base circle portion to a value approximately equal to the fixed radius adjacent the fixed radius portion.

8 Claims, 2 Drawing Sheets

EXTENDED DURATION CAM LOBE FOR VARIABLE VALVE ACTUATION MECHANISM

TECHNICAL FIELD

This invention generally relates to variable valve actuation mechanisms for internal combustion engines and, more particularly, to an output cam for use with a variable valve mechanism.

BACKGROUND OF THE INVENTION

A conventional internal combustion engine utilizes an air throttling device and a timing device. The throttle device is typically a valve that, in response to driver input, regulates the flow of air to the engine intake valves. The timing device includes a crankshaft that drives a rotary, lobed camshaft. Engine intake valves are opened and closed at predetermined angles of crankshaft rotation to allow the descending piston to draw air into the combustion chamber. The shape or lift profile of the cam lobes, in part, fixes the crankshaft angle at which the valves open/close and the amount by which the valves are lifted. The plot of valve lift relative to crankshaft angular position is referred to as a valve lift profile. A conventional engine has an intake valve lift profile that is generally parabolic in shape.

A modern internal combustion engine may incorporate a more advanced throttle control system, such as, for example, an intake valve throttle control system. An intake valve throttle control system, in general, controls the flow of gas and air into the cylinders by varying the timing and/or the amount of intake valve lift. The timing and/or amount of lift is varied dependent upon and in response to engine operating parameters, such as, for example, engine load, speed, and driver input. Intake valve throttle control systems vary the valve lift profile through the use of various mechanical and/or electromechanical configurations, generally referred to herein as variable valve actuating (VVA) mechanisms. One example of a VVA mechanism is detailed in commonly-assigned U.S. Pat. No. 5,937,809, the disclosure of which is incorporated herein by reference.

Conventional VVA mechanisms typically include an output cam lobe that is pivotally oscillated through a predetermined and fixed range of motion. The pivotal motion of the output cam lobe is transferred to opening and/or closing of a corresponding valve. More particularly, the output cam typically engages a roller finger follower that, in turn, engages a corresponding intake valve. The shape or lift profile of the pivoting output cam lobe causes a corresponding displacement or pivot of the roller finger follower and, in turn, a corresponding actuation or lifting of the intake valve. The amount and timing of the valve lift is varied by changing the angular position of the output cam lobe relative to the roller finger follower and/or a central axis of the cam lobe such that the roller finger follower is engaged by a desired portion of the output cam lift profile as it is pivoted.

For example, to impart a large amount of lift to the intake valve, the angular position of the output cam lobe relative to the roller finger follower is established such that the nose or peak of the lift profile is disposed within the fixed range of motion of the output cam. Thus, as the output cam lobe is pivoted through its fixed range of motion the peak of the lift profile engages the roller finger follower thereby actuating or lifting the valve a corresponding and relatively large amount. Conversely, to achieve a small amount of or zero lift the angular position of the output cam lobe relative to the roller finger follower is established such that the roller finger follower is engaged primarily or only by the base circle of the lift profile as the output cam lobe pivots through its fixed range of motion. Thus, the roller finger follower is pivoted and the corresponding valve is actuated a relatively small or zero amount.

Conventional VVAs vary the amount and timing of valve lift in order to, for example, increase engine power, reduce pumping work and/or improve charge preparation. The output cams of such VVAs incorporate conventional lift profiles. Since only the amount and/or timing of the valve lift is varied, the valve lift profiles remain generally parabolic in shape. The amount of valve lift in a given engine is fixed not only by the lift profile of the output cam lobe but also by the valve springs and other valve train components. The limited available or maximum amount of valve lift, in turn, limits the amount of air flow/intake and thereby limits engine power. The limited maximum lift also limits the resolution of, i.e., the difference in lift between, the valve lift profiles. The peak valve lift achieved by the lower-lift profiles must be a certain amount less than the maximum lift.

Therefore, what is needed in the art is an output cam for use with a VVA mechanism that extends the duration of the valve event.

Furthermore, what is needed in the art is an output cam for a VVA mechanism that increases air flow/intake for a given amount of valve lift.

Still further, what is needed in the art is an output cam for a VVA mechanism that increases engine power for a given amount of valve lift.

Moreover, what is needed in the art is an output cam for a VVA mechanism that increases the resolution of valve lift profiles by providing lower lift curves that represent a larger percentage of peak or maximum valve lift.

SUMMARY OF THE INVENTION

The present invention provides an output cam for a variable valve mechanism.

The invention comprises, in one form thereof, a body configured for being pivotally associated with and driven by an input shaft. A lift profile of the output cam includes a base circle portion, a cam portion and a fixed radius portion. The base circle portion is adjacent to and continuous with the cam portion, and the cam portion is adjacent to and continuous with the fixed radius portion. The base circle portion has a base radius, the cam portion has a cam radius and the fixed radius portion has a fixed radius. The base and fixed radii are substantially constant. The fixed radius is a predetermined amount greater than the base radius. The cam radius increases from a value approximately equal to the base radius adjacent the base circle portion to a value approximately equal to the fixed radius adjacent the fixed radius portion.

An advantage of the present invention is that a longer duration lift event is achieved.

A further advantage of the present invention is that engine power is increased for a given amount of valve lift.

A still further advantage of the present invention is that low-lift valve lift profile resolution is improved.

An even further advantage of the present invention is that longer duration lift events are achieved without requiring modifications to associated valve train components.

Yet further, an advantage of the present invention is that the peak or maximum amount of valve lift can be reduced without sacrificing power or air intake/flow.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF THE PREFERRED EMBODIMENTS

Figure 1:
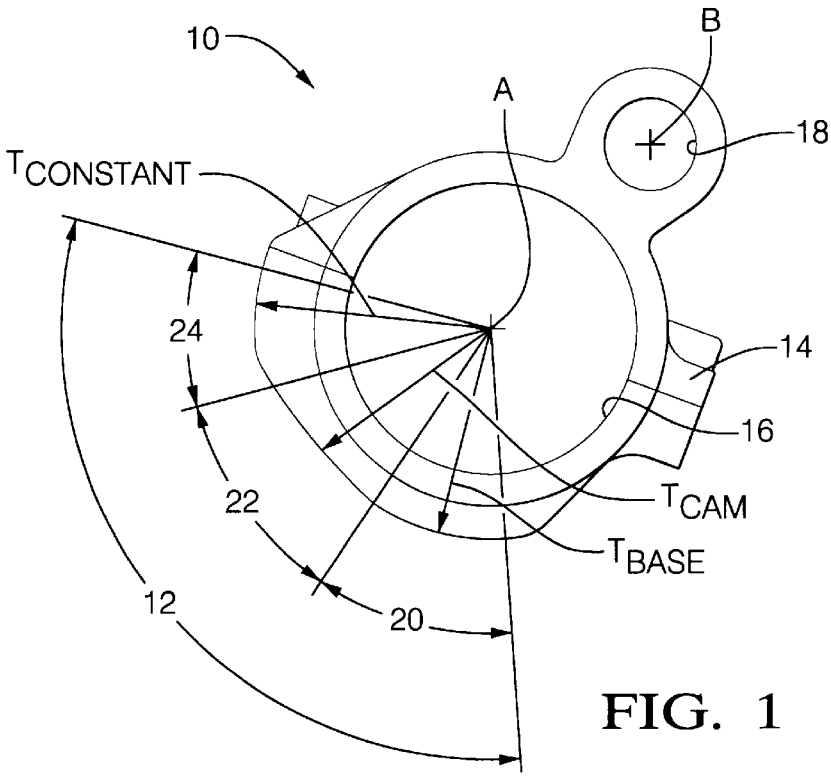
FIG. 1 is a side view of one embodiment an output cam of the present invention.

Referring now to the drawings, and particularly to FIG. 1, there is shown one embodiment of an output cam of the present invention. Output cam 10 includes lift profile 12. Generally, and as will be described with more particularity hereinafter, lift profile 12 of output cam 10 increases the duration of the valve lift event.

Output cam 10 includes body 14. Body 14 is generally annular in shape, and defines central orifice 16 that is substantially concentric relative to a central axis A. Central orifice 16 is configured for receiving a camshaft of an internal combustion engine. Body 14 further defines peripheral orifice 18 that is substantially concentric relative to central axis B, which is substantially parallel to and spaced apart from central axis A. Peripheral orifice 18 is configured for receiving a coupling member, such as, for example, a pin, that couples output cam 10 to a link member of a variable valve mechanism. Body 14 is constructed of, for example, stainless steel or aluminum.

Lift profile 12 is affixed to and/or integral and monolithic with body 14. Lift profile 12 includes three distinct portions or segments, base circle portion 20, cam portion 22 and constant radius portion 24. Base circle portion 20 is adjacent to and continuous with cam portion 22, and cam portion 22 is adjacent to and continuous with constant radius portion 24.

Base circle portion 20 has a substantially constant radius $r_{BASE}$. Cam portion 22 has a radius $r_{CAM}$ that increases in a clockwise direction or in a direction toward constant radius portion 24. Constant radius portion 24 has a substantially constant radius $r_{CONSTANT}$, that is a predetermined amount greater than $r_{BASE}$.

Figure 2:
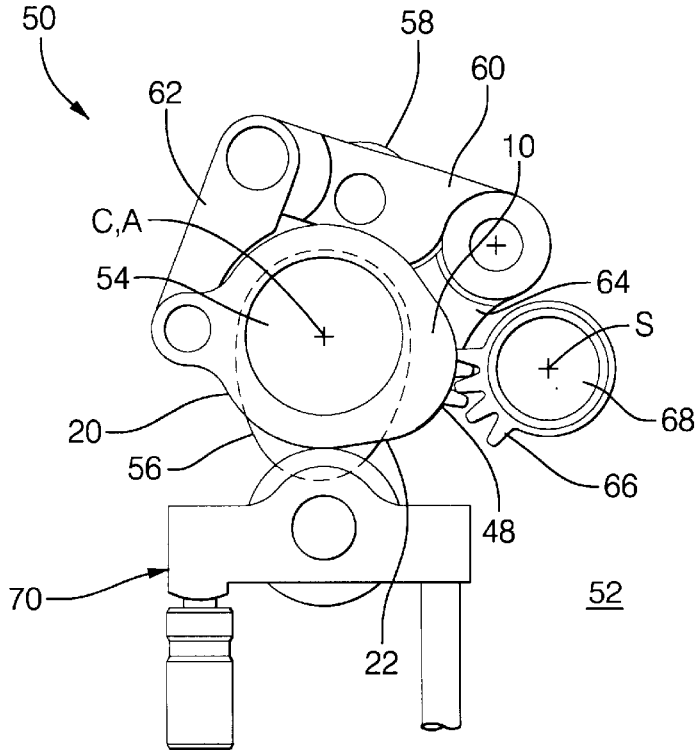
FIG. 2 is a perspective view of a VVA mechanism incorporating the output cam of FIG. 1.

Referring now to FIG. 2, one embodiment of a variable valve actuation (VVA) mechanism incorporating output cam 10 is shown. VVA 50 is operably installed within engine 52. More particularly, VVA 50 is operably associated with rotary camshaft 54 of engine 52. Camshaft 54 has central axis C and includes at least one input cam 56 that engages roller 58. Roller 58 is carried by first link member 60, which is pivotally interconnected with second link member 62. Second link member 62 is, in turn, pivotally interconnected with output cam 10. Frame 64 is pivotally associated with camshaft 54, and is pivotally interconnected with the end of first link member 60 that is opposite second link member 62. Control gear 66 is disposed upon control shaft 68, and engages a corresponding gear (not referenced) carried by or integral with frame 64.

In use, camshaft 54 is driven to rotate by engine 52, such as, for example, via a crankshaft (not shown). Camshaft 54 and input cam 56 rotate as substantially one body, and thus rotation of camshaft 54 results in the rotation of input cam 56. As input cam 56 rotates, the lift profile thereof engages and displaces roller 58 toward and away from camshaft 54 in a generally radial direction. Roller 58 is carried by first link member 60, and thus the rotation of input cam 56 is transferred to displacement of first link member 60 toward and away from camshaft 54 in a generally radial direction. The displacement of first link member 60 is transferred to a corresponding displacement of second link arm 62 toward and away from camshaft 54 in a generally radial direction. The displacement of second link arm 62 is, in turn, transferred to pivotal motion of output cam 10 relative to central axis C.

VVA 50 is configured such that rotation of input cam 56 results in pivotal oscillatory movement of output cam 10 relative to central axis C of a fixed and predetermined magnitude. For example, a full three-hundred and sixty degrees of rotation of input cam 56 results in pivotal motion of output cam 10 through, for example, a magnitude of approximately ninety degrees relative to central axis C (i.e., a forty-five degree pivot in the clockwise direction and a return pivot of forty-five degrees in the counterclockwise direction). As output cam 10 undergoes pivotal oscillatory motion, lift profile 12 engages roller finger follower 70 (schematically represented in FIG. 2) and thus the pivotal motion of output cam 10 displaces or pivots roller finger follower 70 in a generally radial direction away and toward from camshaft 54.

Control shaft 68 is pivoted relative to central axis S thereof to thereby establish the angular position of output cam 10 relative to roller finger follower 70. More particularly, pivoting of control shaft 68 relative to central axis S is transferred via control gear 66 to a corresponding but oppositely-directed pivotal movement of frame 64 relative to central axis C. The pivotal movement of frame 64 is transferred via first and second link arms 60 and 62, respectively, to a corresponding pivotal movement of output cam 10 relative to central axis C. Thus, a "starting" angular position of output cam 10 relative to roller finger follower 70 and relative to central axis C is established by pivoting control shaft 68 to a predetermined angular position relative to central axis S. Placing output cam 10 in a predetermined angular position relative to roller finger follower 10 determines what portion of lift profile 12 (FIG. 1) engages the roller finger follower 70 to pivot.

Further details of the structure and operation of different embodiments of variable valve actuating mechanisms are provided in commonly-assigned U.S. Pat. No. 5,937,809, the disclosure of which, as stated above, is incorporated herein by reference. It should be particularly noted that the structure and operation of VVA 50 from the mechanism viewpoint are substantially similar to the operation and structure of the VVA mechanisms described in U.S. Pat. No. 5,937,809. However, it should further be particularly noted that the valve lift curves obtained by VVA 50 are substantially different from those obtained by the VVA mechanisms disclosed in U.S. Pat. No. 5,937,809 due to the use of output cam 10 in VVA 50.

Figure 3:
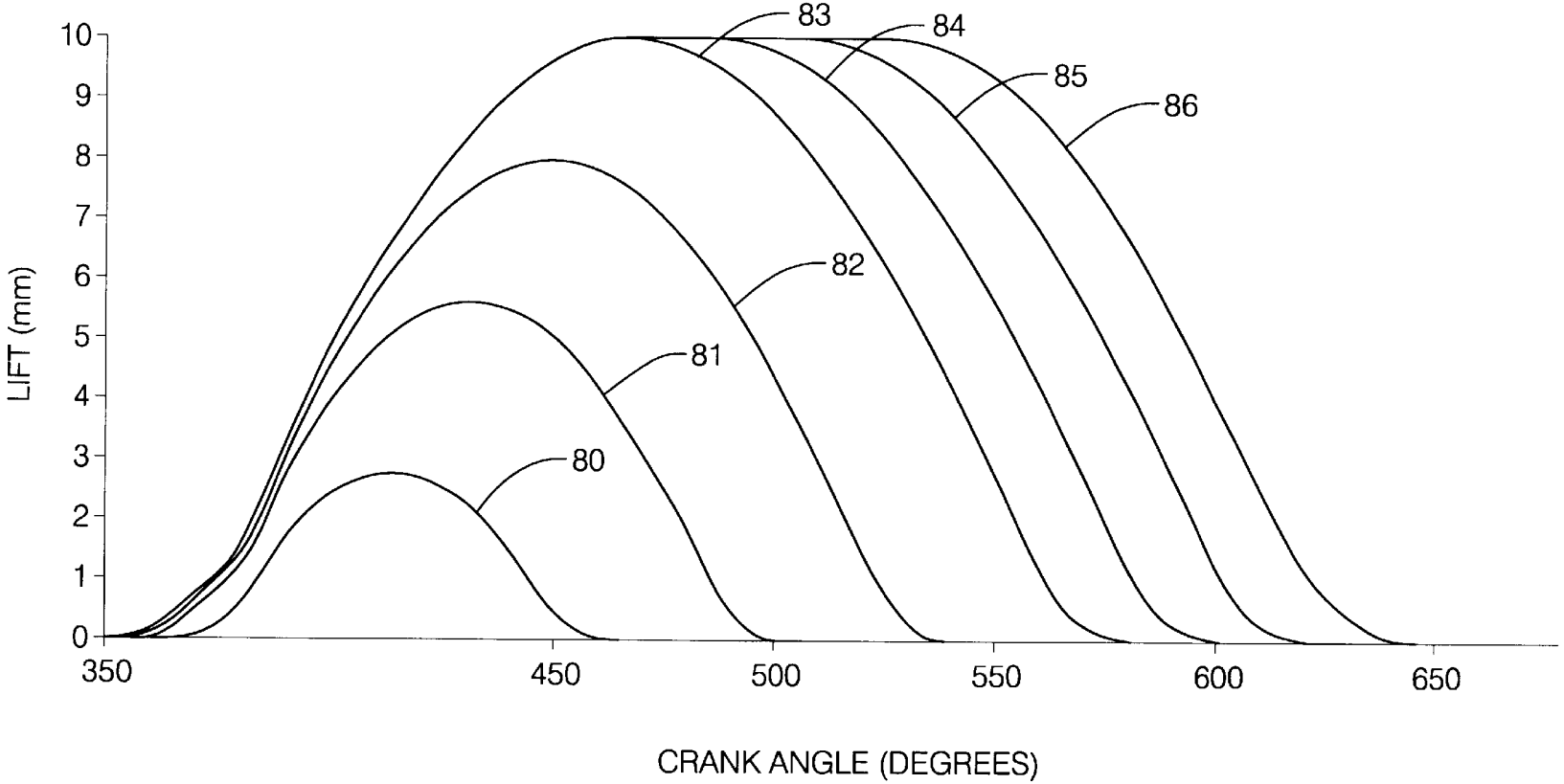
FIG. 3 is a plot of exemplary valve lift profiles obtained with the VVA mechanism of FIG. 2.

Referring now to FIG. 3, a family of exemplary valve lift curves obtained with VVA 50 are shown. Valve lift curves

80, 81, 82, 83, 84, 85 and 86 are obtained by establishing, via control shaft 68, a corresponding angular position of output cam 10 relative to central axis C and/or roller finger follower 70, as described above. For example, lift curve 80 is obtained by establishing the angular position of output cam 10 relative to central axis C such that constant radius portion 24 and a substantial portion of cam portion 22 are disposed at a relatively large angular distance from roller finger follower 70. As output cam 10 is pivoted through its fixed range of motion roller finger follower 70 is engaged primarily by base circle portion 20 and by only a predetermined and relatively small segment of cam portion 22. Thus, lift curve 80 has a relatively short duration and relatively low amount of lift.

Conversely, lift curve 83 is obtained by establishing the angular position of output cam 10 relative to central axis C such that a substantial portion, if not the entirety, of cam portion 22 is in relatively close angular proximity relative to roller finger follower 70. As output cam 10 is pivoted through its fixed range of motion, roller finger follower 70 is engaged primarily by cam portion 22 up to approximately and/or including the peak thereof. Thus, lift curve 83 has a relatively long duration and a relatively high, if not maximum, peak amount of lift.

Generally, lift curves 84, 85 and 86 illustrate how the duration of the valve event is extended by constant radius portion 24 of lift profile 12. More particularly, lift curve 84 is obtained by establishing the angular position of output cam 10 relative to central axis C such that cam portion 22 and a predetermined portion of constant radius portion 24 are in relatively close angular proximity to roller finger follower 70. As output cam 10 is pivoted through its fixed range of motion, roller finger follower 70 is first engaged by cam portion 22 and is then engaged by the predetermined portion of constant radius portion 24. The engagement roller finger follower 70 by cam portion 22 lifts the valve in a substantially similar profile as curve 83 up until the crank angle where constant radius portion 24 engages roller finger follower 70. The engagement of roller finger follower 70 by constant radius portion 24 maintains the lift at a generally constant level, i.e., the peak lift achieved by the engagement of roller finger follower 70 by cam portion 22. Thus, the engagement of roller finger follower by constant radius portion 24 extends the crank angle over which the peak amount of lift is maintained, and thereby extends the duration of the valve event.

The amount (i.e., the crank angle range) by which the valve event is extended is determined by the radial length of constant radius portion 24 that engages roller finger follower 70 during the oscillation of output cam 10. As the radial length of constant radius portion 24 that engages roller finger follower 70 is increased the crank angle range for which peak lift is maintained (i.e., the duration of the valve event) is increased correspondingly. Thus, lift curve 84 is achieved by increasing relative to lift curve 83 the radial length of constant radius portion 24 that engages roller finger follower 70 during the pivotal oscillation of output cam 10. Similarly, lift curves 85 and 86 are achieved by respective increases relative to lift curve 84 in the radial length of constant radius portion 24 that engages roller finger follower 70 during the pivotal oscillation of output cam 10. As described above, the portion or radial length of constant radius portion 24 that engages roller finger follower 70 is determined by the angular position of output cam 10 relative to central axis C.

VVA 50, by extending the duration of the valve event, provides several distinct advantages relative to a conventional VVA. The extended duration valve events provided by VVA 50 increase airflow for a fixed or given amount of valve lift. Thus, installing VVA 50 on an existing engine increases the airflow and power of the engine. It should be particularly noted that the other valve train components, such as, for example, valve springs, would not need to be redesigned if the amount of lift is not changed.

Furthermore, it is desirable to have a design lift curve, i.e., the peak lift curve without any extension in duration and as exemplified by lift curve 83, of a relatively short duration in order to have short duration lower lift curves. By extending the duration of the valve event, VVA 50 enables a desirable reduction in the duration of the design lift curve. Where engine loads require a lift curve above the peak lift curve, i.e., one that provides greater airflow, VVA 50 is adjusted to provide a lift curve having an extended duration to thereby provide the required increased airflow.

Moreover, VVA 50 can be applied to reduce the amount of lift required to provide a given airflow. Generally, for valve lifts above approximately six to eight millimeters, airflow into an engine is limited by the port flow characteristics rather than by the amount of valve lift. Thus, a lower lift valve event having duration extended by VVA 50 provides airflow equivalent to the airflow provided by a higher lift but normal duration (i.e., not extended) valve event.

In the embodiment shown, VVA 50 includes a single output cam 10 to thereby actuate a single valve. However, it is to be understood that VVA 50 can be alternately configured, such as, for example, having a second output cam and associated structure to thereby be configured for use with a cylinder having two intake valves.

In the embodiment shown, VVA 50 is configured to actuate one or more intake valves. However, it is to be understood that VVA 50 can be alternately configured, such as, for example to actuate exhaust valves. It should be particularly noted that configuring VVA 50 to actuate one or more exhaust valves extended exhaust valve duration and expanded charge dilution control capabilities are achieved.

In the embodiment shown, VVA 50 is configured for use with an internal combustion engine. However, it is to be understood that VVA 50 can be alternately configured, such as, for example, for use with various other mechanisms or machinery, such as, for example, air compressors, which may advantageously utilize variable or extended duration of one or more moving components.

In the embodiment shown, the amount of valve lift obtained by VVA 50 is adjusted by establishing the angular position of output cam 10 relative to central axis C to thereby engage roller finger follower 70 with a desired portion of lift profile 12 as output cam 12 undergoes a fixed degree of pivotal movement/oscillation. However, it is to be understood that the present invention can be alternately configured, such as, for example, as changing the degree range over which the output cam is pivotally oscillated relative to central axis C to thereby engage the roller finger follower with more, less or different portions of the lift profile of the output cam.

In the embodiment shown, output cam 10 is illustratively shown and the method of operation thereof illustratively described by reference to an exemplary variable valve actuating mechanism. However, it is to be understood that output cam 10 and the method of operation thereof is compatible with virtually any of the various configurations of known variable valve actuating mechanisms, such as, for example, belt-driven, linkless, cam link and eccentric variable valve actuating mechanisms, and those yet to be developed.

In the embodiment shown, VVA 50 includes link members and a roller that operate to convert rotary motion of the input cam lobe to pivotal oscillatory motion of the output cam. However, it is to be understood that VVA 50 can be alternately configured with various other means to convert rotary motion of the input shaft and/or input cam to pivotal oscillatory motion of the output cam. Such other means include, for example, one or more belts, chains or other links transferring rotation of the input or cam shaft and/or the input cam to pivotal motion of the output cam.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. An output cam for a variable valve mechanism, comprising:

a body configured for pivotal movement relative to a central axis; and a lift profile that is one of affixed to and integral with said body, said lift profile having a base circle portion, a cam portion and a fixed radius portion, said base circle portion being adjacent to and continuous with said cam portion, said cam portion being adjacent to and continuous with said fixed radius portion, said base circle portion having a base radius, said cam portion having a cam radius and said fixed radius portion having a fixed radius, said base radius and said fixed radius being substantially constant, said fixed radius being a predetermined amount greater than said base radius, said cam radius increasing from a value approximately equal to said base radius adjacent said base circle portion to a value approximately equal to said fixed radius adjacent said fixed radius portion.

2. The output cam of claim 1, wherein said body defines a central orifice, said central orifice configured for receiving a shaft to thereby pivotally associate said output cam with said shaft.

3. The output cam of claim 1, wherein said body defines a periphery orifice, said periphery orifice for coupling said output cam to a link member.

4. A variable valve actuation mechanism, comprising:

an output cam having a body;

means for transferring rotary motion of an input shaft to pivotal movement of said output cam; and a lift profile that is one of affixed to and integral with said body, said lift profile having a base circle portion, a cam portion and a fixed radius portion, said base circle portion being adjacent to and continuous with said cam portion, said cam portion being adjacent to and continuous with said fixed radius portion, said base circle portion having a base radius, said cam portion having a cam radius and said fixed radius portion having a fixed radius, said base radius and said fixed radius being substantially constant, said fixed radius being a predetermined amount greater than said base radius, said cam radius increasing from a value approximately equal to said base radius adjacent said base circle portion to a value approximately equal to said fixed radius adjacent said fixed radius portion.

5. The variable valve mechanism of claim 4, wherein said body defines a central orifice, said central orifice configured for receiving a shaft to thereby pivotally associate said output cam with said shaft.

6. The variable valve mechanism of claim 5 wherein said shaft comprises a camshaft of an engine.

7. The output cam of claim 4, wherein said body defines a periphery orifice, said periphery orifice configured for coupling said output cam to a link member.

8. An internal combustion engine, comprising:

a variable valve actuation mechanism including:

an output cam, said output cam having a body;

means for transferring rotary motion of an input shaft of said engine to pivotal movement of said output cam; and a lift profile that is one of affixed to and integral with said body, said lift profile having a base circle portion, a cam portion and a fixed radius portion, said base circle portion being adjacent to and continuous with said cam portion, said cam portion being adjacent to and continuous with said fixed radius portion, said base circle portion having a base radius, said cam portion having a cam radius and said fixed radius portion having a fixed radius, said base radius and said fixed radius being substantially constant, said fixed radius being a predetermined amount greater than said base radius, said cam radius increasing from a value approximately equal to said base radius adjacent said base circle portion to a value approximately equal to said fixed radius adjacent said fixed radius portion.

* * * * *